United States Patent [19]

Suttles

[11] Patent Number: 4,757,769

[45] Date of Patent: Jul. 19, 1988

[54] SHELVING UNIT

[75] Inventor: J. Marshall Suttles, Elberton, Ga.

[73] Assignee: Royston Corporation, Royston, Ga.

[21] Appl. No.: 78,399

[22] Filed: Jul. 27, 1987

[51] Int. Cl.[4] ..... A47B 3/06

[52] U.S. Cl. ..... 108/111; 211/188; 211/195

[58] Field of Search ..... 248/167; 108/111; 211/188, 194, 189, 195

[56] References Cited

U.S. PATENT DOCUMENTS

| | | | |
|---|---|---|---|
| Re. 30706 | 8/1981 | Bustos . | |
| 453,504 | 6/1891 | Rieckert | 108/111 |
| 742,394 | 10/1903 | Churchill . | |
| 1,238,142 | 8/1917 | Hitchcock | 248/167 |
| 2,218,444 | 10/1940 | Vineyard . | |
| 3,279,618 | 10/1966 | Bergstedt . | |
| 3,314,551 | 4/1967 | Plastow . | |
| 3,346,317 | 10/1967 | Peggs . | |
| 3,598,066 | 8/1971 | Polezoes . | |
| 3,908,564 | 9/1975 | Miller | 108/111 |
| 3,931,894 | 1/1976 | Murphy | 211/163 X |
| 3,945,497 | 3/1976 | Greenberg | 211/194 X |
| 3,967,734 | 7/1976 | Morgan et al. . | |
| 4,030,219 | 6/1977 | Donovan . | |
| 4,232,916 | 11/1980 | Correia | 211/194 X |
| 4,294,363 | 10/1981 | Oztekin et al. . | |
| 4,454,948 | 6/1984 | Spamer . | |
| 4,508,231 | 4/1985 | Honickman . | |
| 4,512,591 | 4/1985 | Plante | 211/186 X |
| 4,526,110 | 7/1985 | Franz . | |
| 4,564,111 | 1/1986 | Suttles . | |

FOREIGN PATENT DOCUMENTS 221439 9/1909 Fed. Rep. of Germany ..... 248/167

*Primary Examiner*—Peter A. Aschenbrenner

*Attorney, Agent, or Firm*—Howson and Howson

[57] ABSTRACT

A display-type shelving unit comprises stacked, factory-assembled modules, each of which comprises four vertically elongated hinges connected by horizontal connecting elements and unfoldable from an exaggerated rhomboidal condition in which the connecting members are essentially parallel to one another to a condition in which the connecting elements define a rectangle. Shelves may be dropped into frames formed by the connecting elements to hold the modules in a rectangular condition. Hinge pins project upwardly from each hinge, and a corresponding pin-receiving recess is provided at the bottom of each hinge, so that the hinge pins are used to hold the modules in vertical alignment. The hinges have trim retaining tabs which are appropriately spaced, when the shelf module is in the unfolded condition, to engage slots along the edges of vertically elongated trim strips which serve to hide the knuckles of the hinges from view. Feet are frictionally engaged in the recesses at the bottoms of the hinges of the lowermost module, and caps are engaged with the pins at the tops of the hinges of the uppermost module. These caps allow for attachment of sign panels. In the case of a module having a sloping forward-feed shelf, wire guards are provided, which are held in place by the shelf itself.

11 Claims, 4 Drawing Sheets

FIG. 2
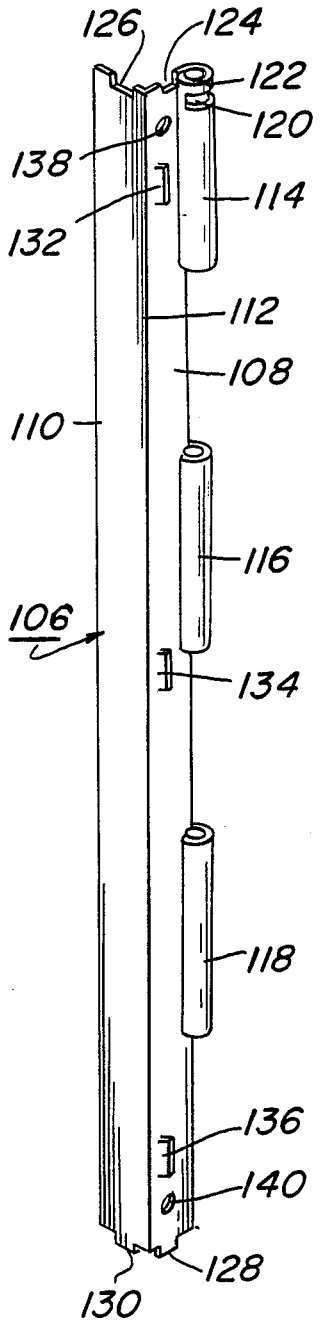
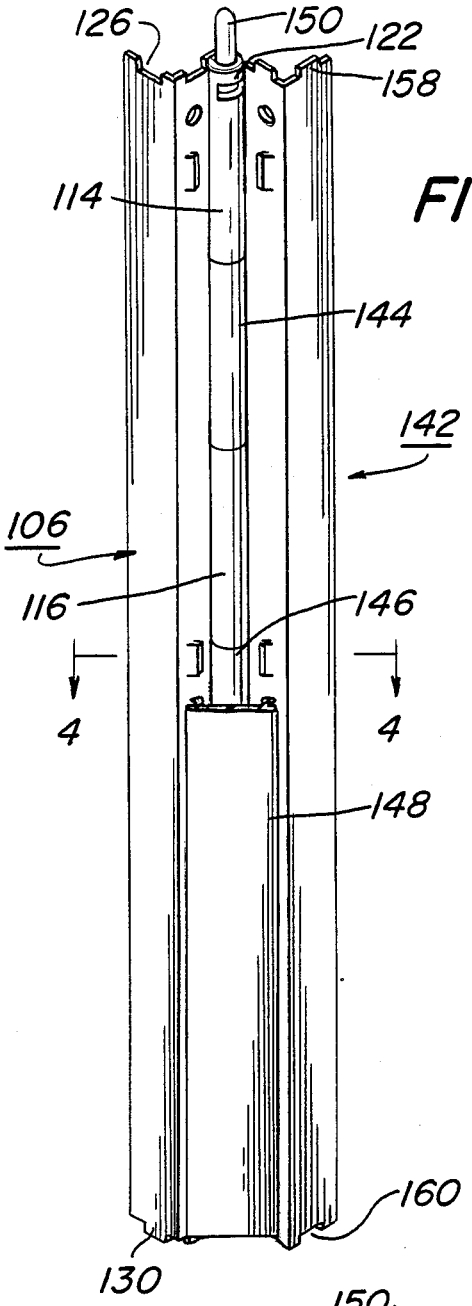
FIG. 3
FIG. 4
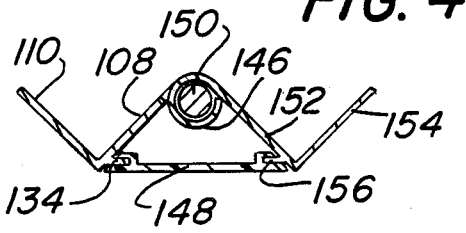

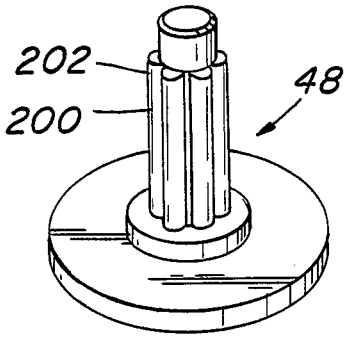
FIG. 8
FIG. 9
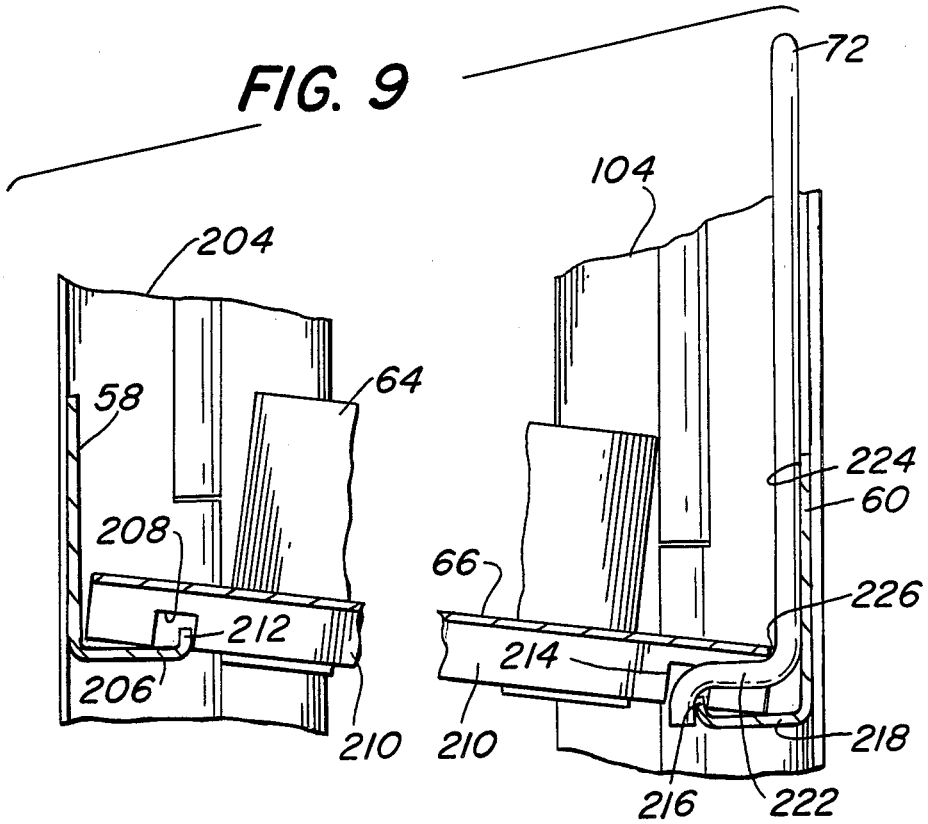

SHELVING UNIT

BRIEF SUMMARY OF THE INVENTION

This invention relates to shelving, and more specifically to shelving units of the type typically used to display wares in supermarkets and the like. The shelving unit of the invention is typically made of sheet metal, and has utility in supermarkets, convenience stores and the like, and also in other retail stores, and wherever else sheet metal shelving is used.

Shelving units are bulky when assembled, and are therefore normally shipped in knocked-down condition and assembled at the site where they are to be used. In most cases, the persons who assemble the shelving units are supermarket and convenience store personnel who are normally assigned other duties, and who have only infrequent occasion to assemble shelving. Frequently, such persons find the unpacking and assembly of shelving units to be an unfamiliar and difficult task. Usually it is necessary to locate and identify numerous different parts, including posts, panels, fasteners, trim, etc., and to assemble all of these parts into a finished shelving unit in accordance with written instructions which are often difficult to follow.

The principal object of this invention is to provide a shelving unit which is capable of being packaged for shipment in knocked-down form in a small and efficient package, but which can be assembled very rapidly and easily by untrained personnel. Another important object of the invention is to permit the user to erect custom shelving which meets his specific needs, by assembling shelving units from factory-assembled modules. Other objects of the invention include the provision of a shelving unit having high strength and rigidity, and reduction of the cost of manufacturing the knocked-down shelving units by minimizing the number of different parts required.

The shelving unit in accordance with the invention comprises a number of interconnected, stacked modules. Each of these modules comprises vertically elongated hinges which are connected, one to another, by rigid connecting members. The hinges allow the individual modules to fold flat for shipment. When the several modules of a shelving unit are unfolded, their hinges are connected together to form the posts of the unit. Shelves are inserted in shelf supports formed by the connecting members of the modules. These shelves hold the modules in the unfolded condition, thereby forming a sturdy and rigid shelving structure.

Each hinge comprises two leaves with interleaved knuckles held together by a hinge pin. The hinge is preferably at least equal in length to the length of its pin, and the pin projects from one end of the hinge, and provides a recess in the knuckle at the opposite end for receiving a pin projecting from a hinge of a next module in the stack. Thus, the hinge pins serve a dual purpose, namely to hold the leaves of the hinges together, and to hold the stacked modules in vertical alignment with one another.

Further objects, details and advantages of the invention will appear from the following detailed description when read in conjunction with the drawings.

BRIEF DESCRIPTION OF THE DRAWINGS

FIG. 2 is a perspective view of a leaf of one of the hinges;

FIG. 3 is a perspective view of a hinge with a trim strip attached to the hinge, the trim strip being partially broken away to show hinge details;

FIG. 4 is a horizontal section taken on plane 4—4 in FIG. 3;

FIG. 8 is a perspective view of a foot for attachment to the bottom of a hinge of the lowermost module of the shelving unit;

FIG. 9 is a vertical section taken on plane 9—9 of FIG. 1, showing the manner in which a shelf is held in one of the shelf support units, and also showing a wire barrier for preventing merchandise from falling off the shelf, and the manner in which the wire barrier is held by the shelf and shelf support module;

FIG. 10 is a fragmentary sectional view showing a hinge of a first module connected by its hinge pin to a hinge of a second module stacked on top of the first module.

DETAILED DESCRIPTION

Figure 1:
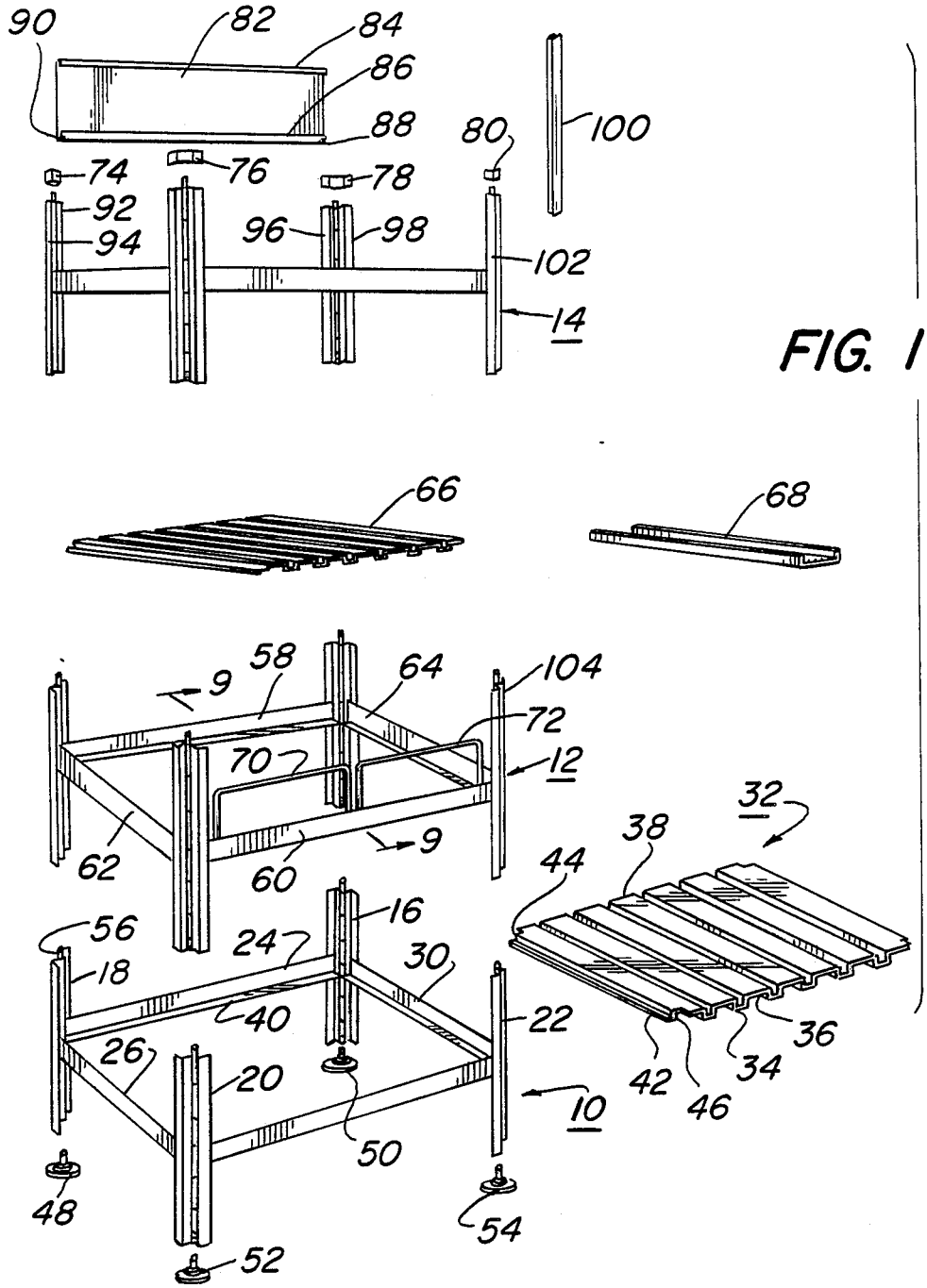
FIG. 1 is an exploded perspective view of a simplified shelving unit in accordance with the invention.

The shelving unit of FIG. 1 comprises three stacked modules 10, 12 and 14. A typical shelving unit will normally consist of more than three modules. However, FIG. 1 shows only three modules for the sake of simplicity.

Module 10 serves as a base module, and comprises four hinges 16, 18, 20 and 22 and four connecting elements 24, 26, 28 and 30. The connecting elements are sheet metal angles having J-shaped cross-sections. The connecting elements are rigidly connected to the leaves of the hinge by welds. The connecting elements and hinges are arranged so that the connecting elements define a rectangle with the hinges located at the corners. The connecting elements meet the hinges at an intermediate location between the upper and lower ends of the hinges. In the case of module 10, all four connecting elements extend horizontally, and the horizontal parts of the angles forming the connecting elements extend inwardly toward the interior of the rectangle to provide a supporting ledge for receiving shelf 32.

Shelf 32 is formed of a single sheet of metal, and has downwardly projecting corrugations as at 34 extending from the front edge 36 to the rear edge 38 of the shelf. The ends of these corrugations at rear edge 38 of the shelf rest on horizontal ledge 40 of connecting element 24, and the ends of the corrugations at the front edge 36 of the shelf rest on a corresponding horizontal ledge (not shown) of connecting element 28. The left-hand edge of shelf 32 has a horizontal flange 42, which is parallel to the lowermost parts of the corrugations, and which rests on a horizontal ledge (not shown) of connecting element 26. The left edge of the shelf is cut away at 44 and 46 to clear hinges 18 and 20 respectively. The right-hand edge of the shelf is similarly configured.

Feet 48, 50, 52 and 54 have pins which fit into recesses at the lower ends of the hinges. Pins which hold the hinge leaves together project upwardly from the upper ends of the hinges, and into recesses provided at the lower ends of the hinges of module 12. One such pin is indicated at 56.

Module 12 is similar to module 10, except that its rearmost horizontal connecting element 58 is located above the level of the front horizontal connecting element 60, and the side connecting elements 62 and 64 slope upwardly from front to rear so that when shelf 66 is inserted and supported by the connecting elements of module 12, it likewise slopes upwardly from front to rear. Shelf 66 is used to support side-by-side extruded channel-shaped tracks 68, which are used to guide soft drink bottles, and which have ridges on which the bottles on each track slide forwardly by gravity when the foremost bottle is removed. Wire barriers are provided at 70 and 72 to prevent bottles from falling over the front connecting element 60 as they slide forwardly.

Upper module 14 is identical to bottom module 10. Its connecting elements are horizontal. The projections of the hinge of pins extending above the upper ends of the hinges of module 14 are received in holes in caps 74, 76, 78 and 80. These caps finish off the upper ends of the posts of the shelving unit, and also serve as attachment points for sign panels, one of which is shown at 82. Sign panel 82 is a sheet metal panel having return flanges 84 and 86 at its upper and lower edges respectively. Flange 86 is notched at 88 and 90. These notches slide along edge 92 of hinge 94 and along edge 96 of hinge 98 respectively. Return flange 84 at the upper edge of panel 82 hooks over parts of caps 74 and 78.

A trim strip, shown in part at 100, slides into the post formed by hinges 102, 104 and 22, hiding the hinge knuckles, and providing the post with a finished appearance. Similar trim strips (not shown) are fitted to the other three posts.

The hinges of the shelving unit modules are preferably identical to one another, and each hinge preferably comprises two identical leaves. One such leaf, 106, is shown in FIG. 2. Leaf 106 comprises two vertically elongated planar portions 108 and 110 meeting each other at a vertically elongated right angle bend 112. Portion 108 has three tubular knuckles formed on it at 114, 116 and 118. The knuckles are of uniform length, and are vertically spaced from one another by the length of a knuckle. Knuckle 114 is located at the upper end of leaf 108, while knuckle 118 is spaced from the lower end of leaf 108 by the height of a knuckle.

Knuckle 114 has a circumferential slot 120 separating the knuckle into an elongated part and a ring 122, which can be crimped against a hinge pin to hold the hinge pin against vertical sliding movement in the knuckles. The upper ends of planar portions 108 and 110 of the leaf have notches 124 and 126 respectively. The sides of these notches are tapered so that the bottom of each notch is slightly narrower than its top opening. Similarly shaped projections 128 and 130 are formed at the lower ends of planar parts 108 and 110.

Trim retaining projections 132, 134 and 136 are struck out from part 108 at spaced locations along the length of the hinge leaf. Holes 138 and 140 allow the leaf to be hung so that it can be painted.

FIG. 3 shows a hinge comprising leaf 106 and an identical leaf 142. Leaf 142 is an upside-down version of leaf 106. Its knuckle 144, which corresponds to knuckle 118 on leaf 106, is located in the space between knuckles 114 and 116. Likewise knuckle 146 is located in the space between knuckles 116 and 118 (the latter being hidden in FIG. 3 by trim strip 148).

Leaves 106 and 142 are held together by a vertically elongated pin 150, which extends from a point above the upper end of knuckle 114 to a point within, and spaced from the lower end of, the lowermost knuckle of leaf 142. Pin 150 is held in place by crimping ring 122 of knuckle 114. Preferably, the length of the pin is just slightly less than the height of the hinge so that the recess formed in the lowermost knuckle is capable of receiving a corresponding pin projecting upwardly from a next lower hinge in a column formed by a series of interconnected hinges. The portion of pin 150 which projects upwardly fits into a recess in a hinge of the next higher module of the unit, or into a top cap.

FIG. 10 shows pin 150 extending upwardly, beyond the upper end of knuckle 114 on leaf 106 of a lower hinge, into knuckle 151 of leaf 153 of an upper hinge. The lower end 155 of the pin of the upper hinge is located above the lower opening of knuckle 151 to provide the recess for the upwardly projecting end of pin 150.

FIG. 4, which is a horizontal section through the hinge of FIG. 3, shows the relationship of the hinge leaves to each other, and to trim strip 148. Planar parts 108 and 152 of the respective leaves are in perpendicular planes, as are planar parts 110 and 154. Thus, connecting elements (not shown) welded to planar parts 110 and 154 extend at right angles to each other. Trim strip 148, which is preferably a rigid or semi-rigid extruded polymeric strip, has slots formed along its vertical edges, which receive trim-retaining projections 134 and 156. Trim strip 148 is preferably installed by sliding it into place after all of the modules of the shelving unit are attached to one another and the shelving unit is brought to its rectangular condition. If vertical space is available, the trim strip can be moved into place downwardly from the top of the unit. If there is insufficient space above the unit when standing, the unit can be laid on its side, and the trim strips can be introduced horizontally. When the trim strips are introduced by this latter method, care must be taken to prevent the unit from folding. Otherwise, one or more of the trim strips may become disengaged from the trim retainers.

Tapered projection 130 and tapered notch 126 in FIG. 3 engage corresponding notches and projections of adjacent hinges, and projection 158 and notch 160 similarly engage notches and projections of adjacent hinges. The engagements of these notches and projections of the outer planar parts of the hinges prevents the hinges of adjoining modules from twisting relative to each other when they are engaged, and thereby aids in holding the hinges in vertical alignment with one another.

Figure 5:
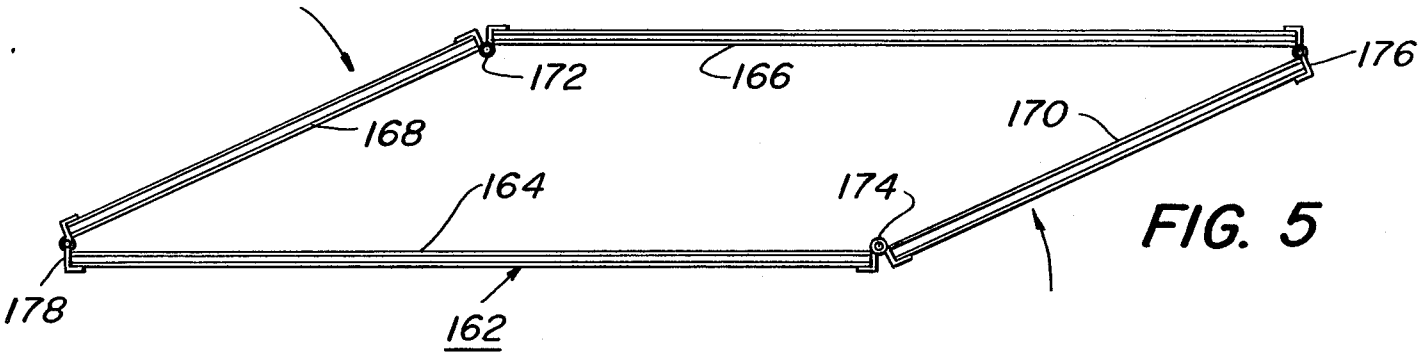
FIG. 5 is a top plan view of a shelving support module of the invention in its partially folded condition.

FIG. 5 shows a shelving support module 162 in a partially folded condition, in which its horizontal connecting elements 164, 166, 168 and 170 are approaching a condition in which they are all parallel to one another. The hinges 172, 174, 176 and 178 are designed to fold through 180 degrees. This allows identical hinges to be used, and allows the shelf support module to be folded in the manner depicted in FIG. 5. When the module is fully folded, the connecting members extend respectively along the four sides of an exaggerated rhomboid, all four sides of which are substantially parallel. The shelf support module is then in a substantially flat condition, and can be shipped along with other modules, shelves, panels and other parts in an efficient space-conserving package.

Figure 7:
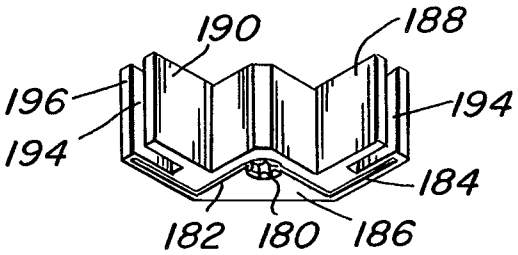
FIG. 7 is a perspective view showing the underside of the hinge cap in FIG. 6.
Figure 6:
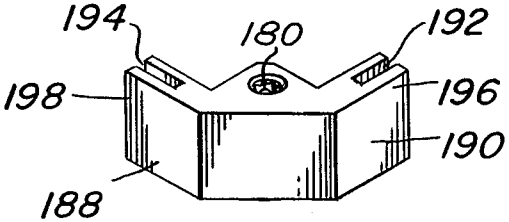
FIG. 6 is a perspective view of a cap used at the top of a hinge of the uppermost module in a shelving unit.

The top cap is depicted in FIGS. 6 and 7, and is preferably a molded polymeric element. It has a through hole 180 of a size adapted to receive a pin projecting upwardly from the uppermost module in a stack. The interior of the hole has longitudinal ribs which frictionally engage the pin. Two L-shaped slots 182 and 184 are formed in bottom face 186 of the cap. These L-shaped slots receive the upper end of a hinge. Wings 188 and 190 are notched at 192 and 194 respectively. The return flange at the upper edge of the sign panel hooks over the outer part 196 of wing 190, and into slot 192. The return flange of an adjacent sign panel hooks over outer part 198 of wing 188, and into slot 194.

FIG. 8 shows a foot 48, which is preferably a molded polymeric foot having a integral upwardly extending stem 200 with vertical ribs 202 which frictionally engage a recess at the lower end of one of the hinges of the lowermost module in a stack. The feet can be installed in the lowermost module before the stack is assembled, and the frictional engagement of the feet in the lowermost module insures that they will remain in place during assembly of the shelving unit.

Referring to FIG. 9, connecting element 58, which is connected to hinge 204, has a horizontal ledge 206, on which rests the rear edge of shelf 66. A notch 208 in corrugation 210 receives upwardly extending ridge 212 along the edge of horizontal part 206, so that the rear parts of the corrugations can rest on horizontal ledge 206.

A similar notch 214 is provided near the forward end of corrugation 210 to receive upwardly projecting ridge 216 at the edge of horizontal ledge 218 of connecting element 60. A flange (not shown) at the far edge of shelf 66 rests on horizontal element 220 of forwardly sloping connecting element 64.

The spacing between the supporting surface of shelf 66 and the bottoms of the corrugations allows room for a horizontal portion 222 of wire guard 72 to extend over ledge 218 and ridge 216 of connecting element 60. The wire guard rests against the inner face 224 of connecting element 60, and is held in place by the front edge 226 of shelf 66. Thus, the shelf itself holds the wire guard firmly in place, and the structure of the sloping shelf module can be easily assembled by placing the wire guards in position, and dropping the shelf into place.

In each of the modules having a shelf, the shelf itself holds the module in a rectangular condition. The top module, which would normally only have side panels, and lacks a shelf, is held in the rectangular condition by virtue of its engagement with the lower shelved modules. The trim strips, if rigid, also serve to a limited extent in holding the shelving unit in a rectangular condition.

The shelving unit of the invention has many advantages over prior shelving units, particularly in its ease of assembly, its versatility, and in its ability to be shipped efficiently in partly assembled condition.

Numerous modifications can be made to the shelving unit of the invention. For example, while a rectangular configuration is normally used for the shelving unit, it is possible to adopt a parallelogram configuration using the same basic modules, by using parallelogram-shaped shelves, and either eliminating the trim strips altogether or modifying them appropriately.

The shelving unit of the invention can comprise any desired number of shelf-support modules, and can comprise a series of identical modules or a combination of two or more different modules.

It is possible to include in a unit having at least one module with four connecting elements, one or more open-front modules having connecting elements only at the rear and sides. These open front modules can have hinges only at the rear corners, and simpler posts at the front corners, with provisions on the posts and hinges for attachment of a shelf at several different selected heights. In the case of an open-front shelving module, the shelf will have special provisions for attachement to the module, as well as reinforcements resisting bending of the shelf.

Although the shelving unit modules specifically described are rectangular, the advantages of the invention can be realized with pentagonal modules, hexagonal modules, or modules of other polygonal shapes having more than four sides. So that the modules are foldable to a flat condition, the sum of the lengths of the connecting elements in a first group of at least two adjoining elements must be substantially equal to the sum of the lengths of the remaining elements. Thus, a trapezoid or an equilateral pentagon will not fold flat. However, a rectangle, and an equilateral hexagon will fold flat, as will a pentagon having two adjacent sides the sum of the lengths of which equals the sum of the lengths of the remaining three sides.

Although sheet metal shelves are shown and described, many of the advantages of the invention can be realized with non-metallic shelves such as shelves of chipboard with a melamine laminate surface.

Numerous other modifications can be made to the invention herein described without departing from its scope as defined in the following claims.

I claim:

1. A shelving unit characterized by a shelving support module comprising at least four vertically elongated hinges, each having two leaves with interleaved knuckles, and pin means extending vertically at least partway through said interleaved knuckles to hold the leaves together while allowing relative rotation of said leaves about the pin means, and a like number of rigid connecting elements, each connecting element having one leaf of one of said hinges rigidly fastened at one of its ends and one leaf of another of said hinges rigidly fastened at its opposite end, the connecting elements extending respectively along the sides of a polygon when the module is in an unfolded condition, and the hinges being located at the corners of the polygon; said hinges allowing the shelving support module to be brought to a folded condition in which the connecting elements extend substantially parallel to one another, in which each of the leaves of each hinge has trim-retaining projection means, and having trim means extending vertically along the outside of each hinge, each said trim means having a pair of vertically extending slots, said trim-retaining projection means on the respective leaves of each hinge being spaced from each other, when the module is in said unfolded condition, by a distance such that the trim-retaining projection means extend into said slots and thereby hold the trim means in engagement with the hinges.

2. A shelving unit according to claim 1 in which the trim-retaining projection means of each leaf are located on a side of the leaf which faces outwardly from the shelving support module when the module is in said unfolded condition, and in which the trim-retaining projection means of each leaf of a hinge project toward the opposite leaf of the same hinge.

3. A shelving unit characterized by a shelving support module comprising at least four vertically elongated hinges, each having two leaves with interleaved knuckles, and pin means extending vertically at least partway through said interleaved knuckles to hold the leaves together while allowing relative rotation of said leaves about the pin means, and a like number of rigid connecting elements, each connecting element having one leaf of one of said hinges rigidly fastened at one of its ends and one leaf of another of said hinges rigidly fastened at its opposite end, the connecting elements extending respectively along the sides of a polygon when the module is in an unfolded condition, and the hinges being located at the corners of the polygon; said hinges allowing the shelving support module to be brought to a folded condition in which the connecting elements extend substantially parallel to one another, in which the pin means of each hinge is fastened to at least one of the knuckles of one of the leaves thereof and thereby secured against vertical movement relative to said knuckles, and in which the pin means projects beyond one end of the hinge in one direction and terminates within the knuckle at the opposite end of the hinge, whereby a recess capable of receiving a portion of a pin means projecting from a hinge of another module is provided in the last-mentioned knuckle.

4. A shelving unit according to claim 3 in which the shelving support module is the bottom module of a stack of modules, and in which the recesses of the hinges of said bottom module are located at the lower end thereof, and having feet, each with a base pad and a stem projecting upwardly therefrom into one of said recesses, and press-fit therein.

5. A shelving unit characterized by a shelving support module comprising at least four vertically elongated hinges, each having two leaves with interleaved knuckles, and pin means extending vertically at least partway through said interleaved knuckles to hold the leaves together while allowing relative rotation of said leaves about the pin means, and a like number of rigid connecting elements, each connecting element having one leaf of one of said hinges rigidly fastened at one of its ends and one leaf of another of said hinges rigidly fastened at its opposite end, the connecting elements extending respectively along the sides of a polygon when the module is in an unfolded condition, and the hinges being located at the corners of the polygon; said hinges allowing the shelving support module to be brought to a folded condition in which the connecting elements extend substantially parallel to one another, in which at least one of the connecting elements comprises a vertical panel, and a horizontal ledge extending from the lower edge of the vertical panel toward the opposite connecting element of the module, and having a shelf supported at least in part by said one of the connecting elements, said shelf comprising a sheet of metal having downwardly projecting corrugations on its underside extending from a front edge thereof to a rear edge, the front ends of the corrugations resting on said horizontal ledge, and including barrier means for preventing articles from falling off the shelf over said one of the connecting elements, said barrier means comprising a wire having a first portion extending horizontally above said one of the connecting elements, and a pair of legs extending downwardly from the ends of the first portion toward said horizontal ledge and resting against the face of the vertical panel on the side thereof facing said opposite connecting element, each leg having a foot extending from the lower end of each leg and underneath the shelf between downwardly projecting corrugations thereof, and the legs being engaged by the shelf and held thereby against movement away from the vertical panel.

6. A shelving unit characterized by a shelving support module comprising at least four vertically elongated hinges, each having two leaves with interleaved knuckles, and pin means extending vertically at least partway through said interleaved knuckles to hold the leaves together while allowing relative rotation of said leaves about the pin means, and a like number of rigid connecting elements, each connecting element having one leaf of one of said hinges rigidly fastened at one of its ends and one leaf of another of said hinges rigidly fastened at its opposite end, the connecting elements extending respectively along the sides of a polygon when the module is in an unfolded condition, and the hinges being located at the corners of the polygon; said hinges allowing the shelving support module to be brought to a folded condition in which the connecting elements extend substantially parallel to one another, in which at least one of the connecting elements has a J-shaped cross-section and comprises a vertical panel, a horizontal ledge extending from the lower edge of the vertical panel toward the opposite connecting element of the module, and a ridge extending upwardly from the edge of the horizontal panel remote from the vertical panel, and having a shelf supported at least in part by said one of the connecting elements, said shelf comprising a sheet of metal having downwardly projecting corrugations on its underside extending from a front edge thereof to a rear edge, the corrugations having notches receiving said ridge, and the front ends of the corrugations resting on said horizontal ledge.

7. A shelving unit according to claim 6 including barrier means for preventing articles from falling off the shelf over said one of the connecting elements, said barrier means comprising a wire having a first portion extending horizontally above said one of the connecting elements, and a pair of legs extending downwardly from the ends of the first portion toward said horizontal ledge and resting against the face of the vertical panel on the side thereof facing said opposite connecting element, each leg having a foot extending from the lower end of each leg and underneath the shelf between downwardly projecting corrugations thereof, the feet at the lower ends of the legs resting on said ridge, and the legs being engaged by the shelf and held thereby against movement away from the vertical panel.

8. A shelving unit characterized by two shelving support modules;

each module comprising at least four vertically elongated hinges, each hinge having two leaves with interleaved knuckles, and pin means extending vertically at least partway through said interleaved knuckles to hold the leaves together while allowing relative rotation of said leaves about the pin means, rotation of said leaves about the pin means, and a like number of rigid connecting elements, each connecting element having one leaf of one of said hinges rigidly fastened at one of its ends and one leaf of another of said hinges rigidly fastened at its opposite end, the connecting elements extending respectively along the sides of a polygon when the module is in an unfolded condition, and the hinges being located at the corners of the polygon; said hinges allowing the shelving support module to be brought to a folded condition in which the connecting elements extend substantially parallel to one another; in which the pin means of each hinge is fastened to at least one of the knuckles of one of the leaves thereof and thereby secured against vertical movement relative to said knuckles, and in which each pin means projects beyond one end of its hinge in one direction and terminates within the knuckles at the opposite end of the hinge, whereby a recess capable of receiving a portion of a pin means projecting from a hinge of another module is provided in the last-mentioned knuckle; and in which the two modules are stacked, one above the other, with the pin means projecting from the hinges of each module all projecting in the same direction and with the pin means projecting from the hinges of one module being received in the recesses of the hinges in the other module, whereby the two modules are fastened together.

9. A shelving unit according to claim 8 in which the recesses of the hinges of the lower of the two modules are located at the lower end thereof, and having feet, each with a base pad and a stem projecting upwardly therefrom into one of said recesses of the lower module, and press-fit therein.

10. A shelving unit according to claim 8 in which each leaf of each hinge has a right angle bend along a vertical line whereby the leaf comprises a first planar portion adjacent the knuckles of the leaf, and a second planar portion spaced from the knuckles and meeting the first planar portion perpendicularly; in which each leaf of each hinge in the upper one of the stacked modules is vertically aligned with a leaf of a hinge in the lower one of the modules, and in which one of each vertically aligned pair of leaves has a projection extending from the second planar portion thereof, and the other leaf of the pair has a recess in the second planar portion thereof receiving said projection, the engagement of said projections and recesses preventing the hinges of the upper and lower modules from twisting relative to one another.

11. A shelving unit characterized by two shelving support modules;

each module comprising four vertically elongated posts, at least two adjacent posts being hinges, each hinge having two leaves with interleaved knuckles, and pin means extending vertically at least partway through said interleaved knuckles to hold the leaves together while allowing relative rotation of said leaves about the pin means, and at least three rigid connecting elements extending respectively along at least three sides of a quadrilateral, the posts being located at the corners thereof; said hinges allowing the shelving support module to be brought to an unfolded condition in which the connecting elements are arranged along sides of a rectangle, and also to a folded condition in which the connecting elements extend substantially parallel to one another; in which the pin means of each hinge is fastened to at least one of the knuckles of one of the leaves thereof and thereby secured against vertical movement relative to said knuckles, and in which the pin means projects beyond one end of the hinge in one direction and terminates within the knuckles at the opposite end of the hinge, whereby a recess capable of receiving a portion of a pin means projecting from a hinge of another module is provided in the last-mentioned knuckle; and in which the two modules are stacked, one above the other, with the pin means projecting from the hinges of each module all projecting in the same direction and with the pin means projecting from the hinges of one module being received in the recesses of hinges in the other module, whereby the two modules are fastened together.

* * * * *